United States Patent [19]

Nonomura et al.

[11] Patent Number: 4,493,666

[45] Date of Patent: Jan. 15, 1985

[54] ELECTRODE CONSTRUCTION AND METHOD OF MAKING THE SAME

[75] Inventors: Kinzo Nonomura, Hirakata; Masanori Watanabe, Katano; Yoshinobu Takesako, Neyagawa, all of Japan

[73] Assignee: Matsushita Electric Industrial Co., Ltd., Kadoma, Japan

[21] Appl. No.: 312,077

[22] Filed: Oct. 16, 1981

[30] Foreign Application Priority Data

Oct. 20, 1980 [JP] Japan ..... 55-147221

[51] Int. Cl.[3] ..... H01J 9/14

[52] U.S. Cl. ..... 445/24; 29/831; 219/121 EK; 219/121 LJ; 445/35

[58] Field of Search ..... 313/458, 417, 422; 29/831; 445/25, 35, 49, 24; 219/121 LG, 121 LJ, 121 EK, 121 EH, 121 LN

[56] References Cited

U.S. PATENT DOCUMENTS

| | | | |
|---|---|---|---|
| 1,794,831 | 3/1931 | Caruso | 29/831 |
| 3,935,500 | 1/1976 | Oess et al. | |
| 3,994,430 | 11/1976 | Cusano et al. | 228/122 |
| 4,137,477 | 1/1979 | Krol et al. | 445/49 X |
| 4,181,563 | 1/1980 | Miyaka et al. | 219/121 LJ X |
| 4,227,117 | 10/1980 | Watanabe et al. | |
| 4,259,367 | 3/1981 | Dougherty, Jr. | 219/121 LJ X |

*Primary Examiner*—Kenneth J. Ramsey

*Attorney, Agent, or Firm*—Cushman, Darby & Cushman

[57] ABSTRACT

In making electrode construction for multiple cathode type flat cathode ray tube, a plural number of parallel strip electrodes are connected to form one sheet by means of connecting means 21, 21 . . . provided between neighboring strips. The connecting means are ribs extending laterally (i.e., in a direction of right angle to said strips from the strip electrodes 33, 33 . . . or 36, 36 . . . . The composite parallel strips formed by connecting by the connecting means are formed by photolithographic process from an Ni-Cr-Fe sheet. The connecting means are cut out by impingement of high energy beams (of laser or electron) after bonding the composite parallel strips onto another higher rigidity electrode member.

1 Claim, 6 Drawing Figures

ELECTRODE CONSTRUCTION AND METHOD OF MAKING THE SAME

BACKGROUND OF THE INVENTION

1. Field of the Invention

The present invention relates to an electrode construction wherein a plural number of stripe-shaped electrodes are held with accurate predetermined pitches each other on other members in insulated relationship, and method of making the same.

2. Description of the Prior Arts

Several proposals have been made on multiple electron beam type flat shaped picture display device, for example in the U.S. Pat. No. 3,935,500 and SID 78 Digest pp. 122 to 127. Furthermore, in order to obtain higher grade picture having larger number of picture elements three of the inventors of the present invention have invented and proposed a simultaneous scanning multiple electron beam type picture display apparatus described in the specification of the Japanese patent application Sho No. 53-106788 filed on Aug. 30, 1978 (not yet examined) and also described in the specification of the U.S. Pat. No. 4,227,117 patented on Oct. 7, 1980. This apparatus can have very large number of the picture element in comparison with number of electron extracting apertures of its control electrode.

The structure of picture image display apparatus of the above-mentioned U.S. Pat. No. 4,227,117 is shown in FIG. 1 which is an exploded view of the principal part of the above-mentioned apparatus. The apparatus comprises, as shown from the upper part to the lower part in FIG. 1, an isolation electrode 200 having a plural number of isolation walls 201 to define oblong isolated spaces 202, a row of predetermined number M (e.g. M=15) of parallel disposed linear thermionic cathodes 1 (i.e., line cathodes, each of which comprises a linear filament line to be heated by a low voltage, e.g., D.C. 10 V, and electron emissive oxide coating thereon, and hereinafter is referred to as linear thermionic cathode) each being disposed in the isolated spaces 202, an extractor electrode 300 having a predetermined number N (e.g. N=107) of electron beam passing apertures 300*a* disposed in rows below the linear thermionic cathodes 100, a row of control electrodes 400 for controlling beam intensity disposed parallelly in a direction perpendicular to those of said linear thermionic cathodes 100 each having electron beam passing openings 400*a* below the apertures 300*a*, an electron beam forming electrode 500 having electron beam passing openings 500*a* below the openings 400*a*, a row of vertical deflection electrodes comprising pairs of common-connected first electrodes 600 and common-connected second electrodes 600', a row of horizontal deflection electrodes comprising pairs of common-connected first electrodes 700 and common-connected second electrodes 700', an electric field shielding electrode 800, an anode 900 of vapor-deposited thin aluminum film, and a phosphor screen 1000 formed on a face panel 1100 of a vacuum enclosure and under said anode 900. All electron beams e, e . . . pass through deflection spaces 620, 620 . . . and 720, 720 . . . defined by the deflection electrodes pairs 600, 600' . . . and 700, 700' . . . disposed regularly in the same order with respect to every electron beams as shown in FIG. 1.

In the operation of such multiple electron beam type flat display apparatus described in the above-mentioned specifications, scannings of beam spots on the phosphor screen are made in a modification of known line-at-a-time type scanning, wherein ordinary time-sequential image signal is converted into a plural number of parallel signals. For example, by taking a case to display an image field raster having numbers of picture elements of 240 (in vertical direction) times 321 (in horizontal direction), with regard to the horizontal scanning of the beam spots the raster is divided into a plural number N of vertically oblong sections, wherein the horizontal scannings are carried out parallelly in all of N sections. Then, each section has picture elements of n=321/N in the horizontal direction. For example, when the number N of the vertical sections is 107, the number n of picture element in each section is 3. For such example, 107 beam spots are produced from each linear thermionic cathode and 107 control electrodes are provided in order to control the 107 electron beam intensities. In the apparatus, the horizontal scanning is made by using saw-tooth wave having a horizontal scanning period H applied to the horizontal deflection electrode and in a manner that all the N beam spots are deflected simultaneously to scan in the same direction taking one horizontal scanning period H. The horizontal scanning period H is equal to the horizontal scanning period of the ordinary time sequential television signal. In order for attaining such line-at-a-time-scanning, the ordinary time sequential image signal is preliminarily converted into the N parallel signals of the line-at-a-time type, each signal thereof comprising time sequential elements for three picture data.

The vertical scanning of the described apparatus is made by dividing the raster into a plural number M of horizontally oblong sections, and at first in the first section, for example in the uppermost section, the plural number of beam spots, which simultaneously scan, also scan vertically (downwards). When the vertical scanning in the first section is over and all the beam spots reach the bottoms of the first horizontally oblong sections, then the forming of electron beams from the electron from the first linear thermionic cathode ends and the forming of electron beams from the electrons from the second linear thermionic cathode starts, and the vertical scannings of the beam spots start in the second horizontally oblong section and scan downwards in the same way as in the first section. The vertical scanning is made thus downwards to the bottom or M-th section by applying a saw-tooth wave having a period V/M, where V is the vertical scanning period of the ordinary television signal. For the above-mentioned example of the raster having the number of vertical picture element of 240, when the number M of the horizontally oblong sections is 15, each of the sections has the horizontal scanning lines of a number of m=240/15=16. That is to say, the example apparatus uses 15 linear thermionic cathodes, and each cathode vertically scans to produce 16 horizontal scanning lines.

In such picture display apparatus, as elucidated in reference to FIG. 1, a high precision structure is required in positional relations, i.e. pitches between very fine parallel strip electrodes, in order to obtain accurate scanning and beam current controlling necessary for high grade picture.

In general, the electrodes other than cathodes of such flat type picture display apparatus are made of Ni-Cr-Fe alloy, and strip electrodes have considerable length and are assembled with predetermined narrow pitches in the row. And these long and fine strip electrodes are fixed on another electrode member such as a metal sheet having a lot of electron beam passing apertures, by utilizing insulating gap spacer of glass or ceramic. And bonding of the above-mentioned members are made by using dot shape pieces or strip shape pieces of sealing glass (i.e., low melting temperature glass frit).

Hitherto, the strip shaped parallel electrodes 400, 600 and 720 of FIG. 1 have been produced by carrying out photo-etching on a thin metal film, in a manner that a parallel row of strip shaped electrodes 1, 1 are connected by supporting beams 21, 21 on both end parts thereof as shown by FIG. 1A. The parallel strip electrodes 1, 1 . . . , formed as shown by FIG. 1A are then bonded by, for example pieces of sealing glass (not shown) onto other electrode members such as other parallel strip electrodes disposed in the right direction to the former, or a sheet form electrode member. And thereafter, the connecting parts 2, 2 . . . at both ends are cut out by scissors or the like tools thereby dividing the row into individual strips.

In such conventional manufacturing method of the strip electrodes, there has been the problem that the thin and narrow metal strips tend to sag or bend or be twisted, and therefore, bonding of the strip electrodes tend to be inaccurate, thereby making pitch or gaps between the parallel electrode not uniform, and distortion from designed position is likely to occur at the middle parts 3 of the strip electrodes 1, 1 . . . Such distortion of the electrodes leads to distortion of displayed image thereby disabling high grade picture reproduction. For example, in the case that strip electrodes of 200 mm length×0.7 mm width×0.2 mm thickness in 1 mm pitch are disposed in parallel row with 0.3 mm gap between each other, the inbetween gap often narrowed to 0.1 to 0.2 mm or broadened to 0.4 to 0.5 mm, and such deviations from the designed gap causes distortions of picture pattern and also distortion of brightness and colors displayed.

Also, the divergence of vertical gap between the upper electrode member and the lower electrode members or vertical level difference between neighboring strip electrodes should be controlled to be within a limit of 0.05 mm, especially for horizontal deflection electrodes, in order to obtain high grade picture displaying. And therefore, the vertical sag or bending of the strip electrode which causes inaccuracy of the vertical gap should be minimized, as well as minimizing of the dispersion of the horizontal gaps between neighboring strip electrodes.

SUMMARY OF THE INVENTION

The present invention purposes to provide an improved flat type display apparatus and making method thereof capable of obtaining high grade picture display.

The present invention especially concerns improved electrode construction suitable for attaining the above-mentioned purpose.

DESCRIPTION OF PREFERRED EMBODIMENTS

Figure 1:
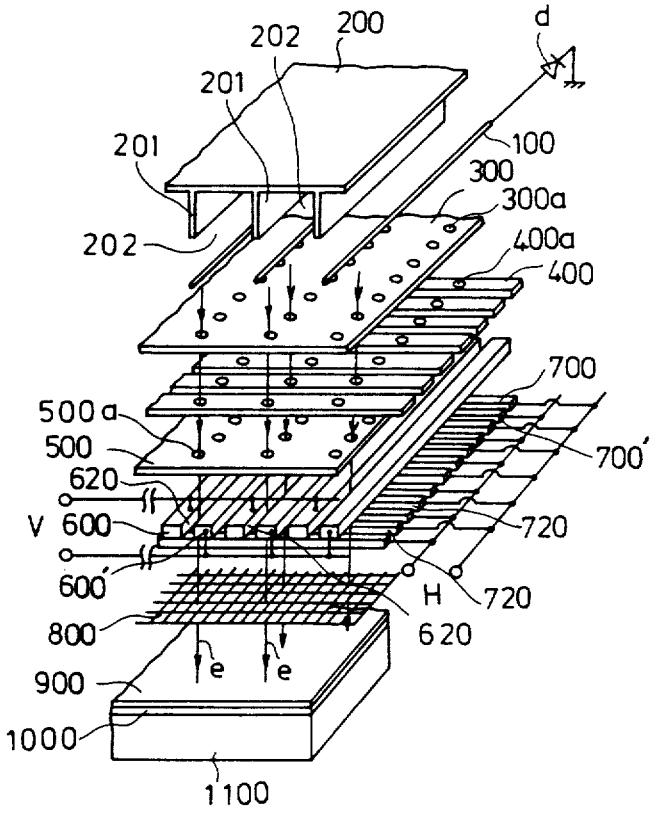
FIG.1 (Prior Art)
FIG. 1 is an exploded perspective view of substantial part of a conventional multiple cathode type flat picture display apparatus.
Figure 1A:
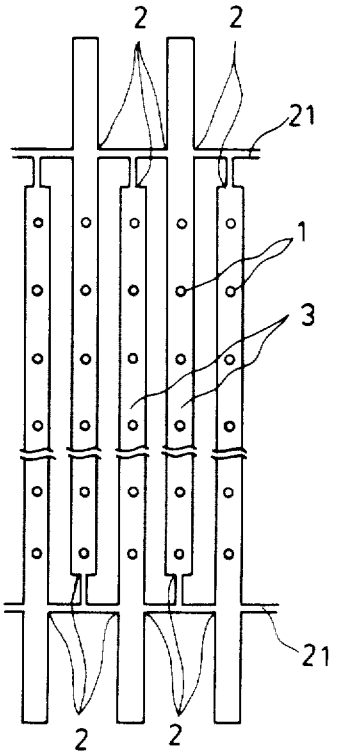
FIG. 1A (Prior Art)
FIG. 1A is a plan view of a composite strip electrodes for use in the conventional apparatus of FIG. 1.
Figure 2:
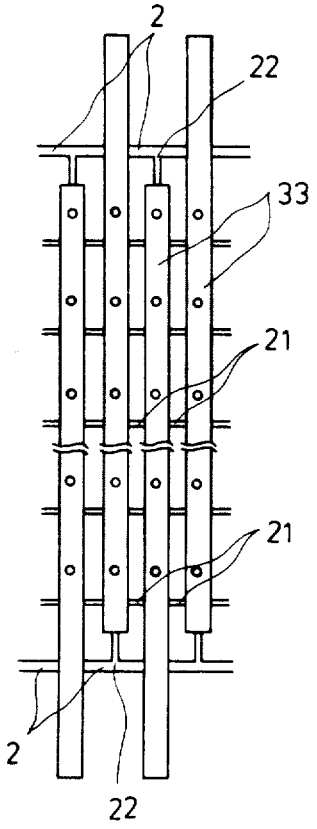
FIG. 2 is a plan view of a composite strip electrodes in accordance with the present invention.
Figure 3:
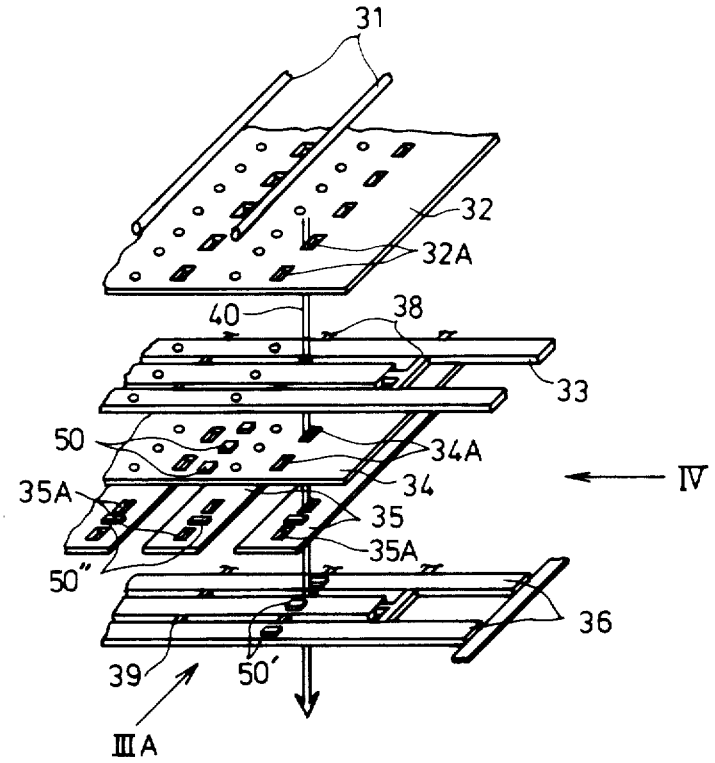
FIG. 3 is an exploded perspective view of a principal part of a flat type picture display apparatus in accordance with the present invention.
Figure 3A:
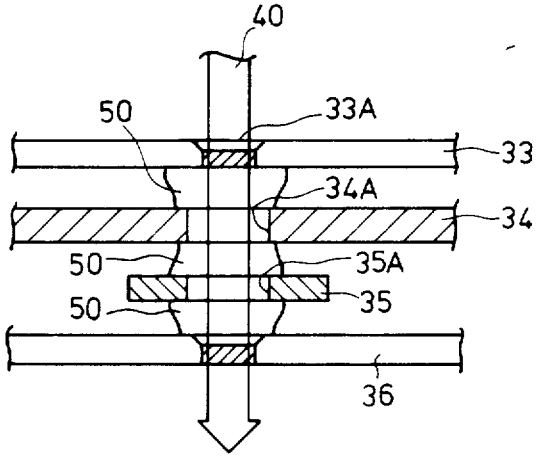
FIG. 3A is a sectional side view of a part of the apparatus shown in FIG. 3, seen from the direction of arrow III A therein.

FIG. 2 is a plan view of the composite strip electrode in accordance with the present invention, wherein parallel strip electrodes 33, 33 are formed in a row connected each other, not only by connection beams 2, 2 . . . at both ends thereof, but also by short connection ribs 21, 21 . . . which are provided substantially in the direction perpendicular to the strip electrodes 33 and at intermediate parts of the strip electrodes 33, and connect them with each other. Thus the composite strip electrodes are formed like a lattice or grid. The grid-like composite strip electrodes as control electrodes 33, 33 . . . are then bonded on other electrode member(s) such as an electron beam forming electrode 34 shown in FIG. 3, by bond, such as pieces of sealing glass 50, 50 . . . Other grid-like composite strip electrodes 35, 35 . . . for vertical deflection are similarly bonded by the pieces of sealing glass 50', 50' . . . on other grid-like composite strip electrodes 36, 36 . . . for horizontal deflection. And further, the parallel strip electrodes 35, 35 . . . are bonded on the lower face of the electron beam forming electrode 34 by pieces of sealing glass 50''. The vertical deflection electrodes 35, 35 . . . are relatively thick and wide and disposed with such a large gaps of 2 mm between each other, and therefore sag or bending leading to distortion is not liable to occur. But the gaps of the control electrodes 33, 33 . . . are such fine as 0.2 to 0.3 mm and its length is 200 mm long, and therefore is liable to be bent by about 0.1 mm, which fatally distorts displayed pictures especially when the apparatus is used as color picture display apparatus. However, according to the present invention, such undesirable bending of the fine strip shaped electrodes is prevented by means of lateral connection means 21, 21 . . . which connects at least one intermediate parts of the parallel disposed strip electrodes, as shown by FIG. 2.

Figure 4:
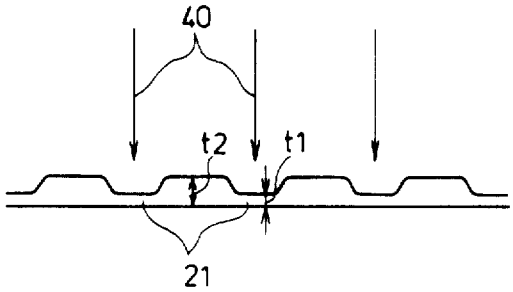
FIG. 4 is a sectional front view of a part of the apparatus shown in FIG. 3, seen from the direction of arrow IV therein.

Method of making such laterally connected parallel disposed strips electrodes 33, 33 . . . in accordance with the present invention is as follows:

At first, by photolithographic etching method, a 0.2 mm thick sheet of known 42-6 alloy, which contains 42% Ni, 6% Cr and 52% Fe, is etched thereby to make grid shaped composite strip electrodes for the control electrodes 33, 33 . . . and horizontal deflection electrodes 36, 36 . . . . The patterns of the composite control electrodes 33, 33 . . . and the horizontal deflection electrodes 36, 36 . . . are as shown in FIG. 2, that is, the parallel strip electrodes are connected by at least one lateral connection means 21, 21 . . . at intermediate positions thereof. The connection means 21, 21 . . . are formed as continuous members extending laterally from the strip electrodes, and is preferably thinned as shown by FIG. 4 by additional chemical etching during the etching to make the grid shaped pattern, so that the thickness $t_1$ of connection means are thinner than the thickness $t_2$ of the strip electrodes. Some of the electrode members, that is, the electron beam take out electrode 32, the convergence electrode 34, and the vertical deflection electrodes 35, 35 . . . have apertures 32A, 32A . . . , 34A, 34A . . . and 35A, 35A . . . , respectively. These are formed for example by photolithographic method prior to the assembling of the electrode construction. The electrodes members are then assembled in one unit by bonding the members with a number of pieces 50 and 50′ of sealing glass. The pieces of the sealing glass for bonding are disposed on the electrode members at the positions other than the apertures 32A, 32A . . . , 34A, 34A . . . and 35A, 35A . . . , respectively. One preferred example of forming the pieces of the sealing glass is, firstly forming a first kind pieces of frit of about 0.2 to 0.3 mm thickness or height and the pieces are hardened by carrying out temperature, and then a frit glass is further applied thereon by about 0.2 mm thick, and the frit glass is heated to about 450° C. to melt and bond the electrode members, each other.

The above-mentioned assembled electrode construction is then subjected to cutting out process of the connection means 21, 21 . . . of the control electrodes 33 . . . and horizontal electrodes 36, 36 . . . , by impingement of a strong energy beam 40, for example, laser beam or electron beam of about 0.2 mm diameter through the apertures 32A, 32A . . . , 34A, 34A . . . and 35A, 35A . . . In order to enable the cutting out process, the apertures are arranged above on a vertical line which connects the corresponding connecting means 21, 21 . . . of the control electrodes 33, 33 . . . and horizontal deflection electrodes 36, 36 . . . By such impingement of the high energy beam 40 through the apertures 32A, 34A and 35A, the connecting means 21, 21 . . . on the corresponding position are vaporized and cut out, and neighboring parallel strip electrodes are disconnected from each other. Necessary sequence of the cutting is made, for example, by displacing the assembled construction by means of X-Y motion table, in a manner that the laser beam or electron beam relatively is transferred from one connection means to the next ones. By means of such method, multi-layered construction of the parallel strip electrodes are assembled with high accuracy of electrode gap and parallelism without undesirable sag or bending of the strip. Therefore, the accuracy of picture pattern, and uniformity of brightness are attainable.

In the above-mentioned construction, the connection means 21, 21 of the composite control electrodes 33, 33 . . . and the composite horizontal deflection electrodes are disposed in the corresponding position, under the through apertures 32A, 34A and 35A. Therefore, a plural connection means disposed at upper and lower positions are cut away by the same laser beam 40. In order to enable such cutting, the apertures 32A, 34A and 35A for impingement of the high energy beam are to be arranged on the corresponding upper and lower positions, and the pieces of sealing glass as bond to assemble the electrode members are to be arranged in the positions which are other than those on the lines of the impinging high energy cutting beam and on the lines of the display electron beams.

Of course, the method of cutting out only one connection beam can be usable.

The connection means 21, 21 . . . is preferably made to be thinner than the strip electrodes 33 or 36, in order for enabling cutting in a short time. Such thinning can be made by means of half-etching. One example of actual cutting is that a connection means 21 having 0.2 to 0.3 mm length × 0.1 to 0.2 mm width × 100 μm thickness of the Ni-Cr-Fe alloy can be cut within about 200 m sec by means of laser beam of a YAG laser.

The pattern of the connecting means 21, 21 . . . of the above-mentioned example is regularly arranged like lattice or grid. But the pattern can be modified suitably within a limit to ensure rigidity of the composit strip shaped electrode members.

What is claimed is:

1. A method for making an electrode construction for a flat-type display device comprising the steps of:

photolithographically forming a composite electrode comprising numerous strip electrodes each connected to the other by connecting means substantially adjacent each end of said strip electrodes and at least one intermediate position;

bonding said composite electrode to another electrode of higher rigidity so that they are in stacked relationship with each other; and cutting out said connecting means by means of a high energy beam, wherein each said connecting means corresponding to said at least one intermediate position is located over aperature means in said another electrode to allow the passing through of said high energy beam during the cutting, and thereby obtaining electrically isolated but mechanically rigidly held parallel strip electrode members.

* * * * *